United States Patent [19]

Melan et al.

[11] Patent Number: 4,787,796

[45] Date of Patent: Nov. 29, 1988

[54] APPARATUS FOR LINING THE INNER WALL OF A VESSEL WITH BRICKS

[75] Inventors: Corneille Melan; Victor Kremer; Michel Kirchen, all of Luxembourg; Emile Lonardi, Bascharage; Jean Liesch, Esch sur Alzette; Andre Boch, Luxembourg; Joseph Colon, Belvaus; Charles Hennico, Useldange, all of Luxembourg

[73] Assignees: Paul Wurth S.A.; Arbed S.A., both of Luxembourg, Luxembourg

[21] Appl. No.: 104,313

[22] Filed: Oct. 2, 1987

[30] Foreign Application Priority Data

Oct. 3, 1986 [LU] Luxembourg ..... 86619

[51] Int. Cl.[4] ..... C21C 5/44; E04G 21/16

[52] U.S. Cl. ..... 414/10; 266/281; 414/223

[58] Field of Search ..... 414/10, 233; 266/281; 52/747, 749

[56] References Cited

U.S. PATENT DOCUMENTS 4,708,562 11/1987 Mélan et al. ..... 414/10
4,720,226 1/1988 Legille et al. ..... 414/10

FOREIGN PATENT DOCUMENTS 1154131 9/1963 Fed. Rep. of Germany ..... 266/281
508529 5/1976 U.S.S.R. ..... 266/281

*Primary Examiner*—Leslie J. Paperner
*Attorney, Agent, or Firm*—Fishman, Dionne & Cantor

[57] ABSTRACT

The apparatus comprises an operating station with a rotary work platform, a non-rotary supporting stage supporting the work platform by means of a first bearing, a robot for laying the bricks, a monitoring booth, a device for raising and lowering brick pallets and at least one automatic brick-depalletizing mechanism for transferring the bricks from the pallets towards a stand-by station. This stand-by station comprises a turret which can contain a reserve of bricks of different types and which is supported by the stage by means of a second bearing, so as to be rotatable independently of the stage and the platform about the vertical axis of the vessel. The apparatus is particularly well suited for repairing metallurgical converters.

12 Claims, 4 Drawing Sheets

APPARATUS FOR LINING THE INNER WALL OF A VESSEL WITH BRICKS

BACKGROUND OF THE INVENTION

This invention relates to an apparatus for lining the inner wall of a vessel with bricks. More particularly, this invention relates to a brick lining apparatus comprising an operating station capable of being moved vertically along the axis of the vessel and including a rotary work platform, a non-rotary supporting stage carrying tee work platform by means of a bearing, a robot for laying the bricks, a monitoring booth, means of raising and lowering brick pallets, and at least one automatic brick-depalletizing mechanism for transferring the bricks from the pallets towards a novel stand-by station.

Various apparatuses employing robots, particularly for laying the refractory lining of a metallurgical converter, have recently been proposed. Of these apparatuses, an essential distinction can be made between two types, namely those in which the bricks are depalletized within the vessel, as in Luxembourg Patent Application No. 80.114 (corresponding to U.S. application Ser. No. 915,635 filed Oct. 6, 1986, now U.S. Pat. No. 4,708,562, assigned to the assignee hereof, all of the contents of which are incorporated herein by reference); and those in which depalletizing is carried out outside the vessel, as disclosed in Luxembourg Patent Application No. 86.382 (corresponding to U.S. application Ser. No. 033,138 filed Apr. 1, 1987, assigned to the assignee hereof, all of the contents of which are incorporated herein by reference). Each of these apparatuses has its own particular advantages. Thus, for example, the advantage of apparatuses with depalletization occurring inside the vessel is that execution takes place relatively quickly, since, in addition to the relatively short idle times necessary for changing the pallets, the two types of bricks required are permanently available on the work platform.

The advantage of the apparatuses with outside depalletization is that there is a reduction in the overall size of the platform. Such reductions make it possibile to install a comfortable monitoring booth on the platform thus contributing to the safety of the personnel supervising the brick-lining of the wall of the vessel. Another advantage of these apparatuses (outside depalletizing) is the possibility that standard robots can be used, that is, robots which do not have to be designed specially for the jobs for which they are intended. Unfortunately, these apparatuses require sophisticated hoists and complex programs for selectively delivering the two presently used configurations of bricks to the platform at the work rate of the robot laying them.

SUMMARY OF THE INVENTION

The above-discussed and other drawbacks and deficiencies of the prior art are overcome or alleviated by the novel robotized apparatus of the present invention which combines the advantages of the apparatuses with depalletization on the inside and the advantages of those with depalletization on the outside.

The present invention comprises an operating station capable of being moved vertically along the axis of the vessel. The operating station includes a rotary work platform, a non-rotary supporting stage carrying the platform by means of a first bearing, a robot for laying the bricks, a monitoring booth, means for raising and lowering brick pallets and at least one automatic brick depalletizing mechanism for transferring the bricks from the pallets towards a novel stand-by station.

An important feature of the present invention is that the novel stand-by station comprises a turret which can contain a reserve of bricks of different types and which is supported by the stage by means of a second bearing. This second bearing support permits the turret to be rotatable independently of the stand-by stage and the platform about the vertical axis of the vessel. In accordance with one embodiment of the present invention, this turret is mounted between the stage and the platform. Preferably, the surface of the platform is completely closed, with the exception of at least one preferably radial aperture allowing the passage of a brick.

The turret preferably consists of an inclined annular ramp divided into individual inclined compartments, each containing at least one brick which is deposited therein by the automatic depalletizing mechanism or mechanisms. Each of these compartments of the turret is accessible to the robot both via the radial aperture in the platform and as a result of the rotation of the turret.

In another embodiment of the present invention, a device is provided for extracting the bricks from the turret via the aperture in the platform, this device being arranged on the platform next to the aperture and accessible to the arm of the robot. The supporting stage is preferably equipped with two winches for raising and lowering two pallets; while depalletization is carried out by two automatic mechanisms fixed to the supporting stage.

The apparatus of the present invention is consequently an intermediate solution between the apparatuses with depalletization on the outside and those with depalletization on the platform. In fact, in the present invention, depalletization is not carried out on either the outside or on the platform, but on the hoist (for example, by leaving the pallets attached to the cables of their winches which serve for raising the pallets to the operating station). Because depalletization is no longer carried out on the platform, all that remains thereon is the robot for laying the bricks, the monitoring booth and the aperture for the passage of the bricks. As a result, the problem of the overall size of the work platform, which was all the more difficult when the vessels to be lined with bricks were small, has been satisfactorily solved by the present invention. Moreover, since the bricks are presented to the robot individually or in superimposed pairs and always in the same position, and the robot has the space necessary for executing its movements, the robot can be a conventional commercially available robot, whereas in the prior art, it has been necessary to design a robot which is specifically adapted to the space available on the platform.

The turret preferably contains a sufficient reserve of bricks of each of the two conventional types, to allow the robot to continue its work during a time when an empty pallet is replaced by a full pallet. Consequently, the idle times necessary for the changes of pallets are reduced or eliminated completely.

The above discussed and other features and advantages of the present invention will be apparent to and understood by those skilled in the art from the following detailed description and drawings.

DESCRIPTION OF THE DRAWINGS

Referring now to the drawings, wherein like elements are numbered alike in the several FIGURES.

DESCRIPTION OF THE PREFERRED EMBODIMENT

Figure 1:
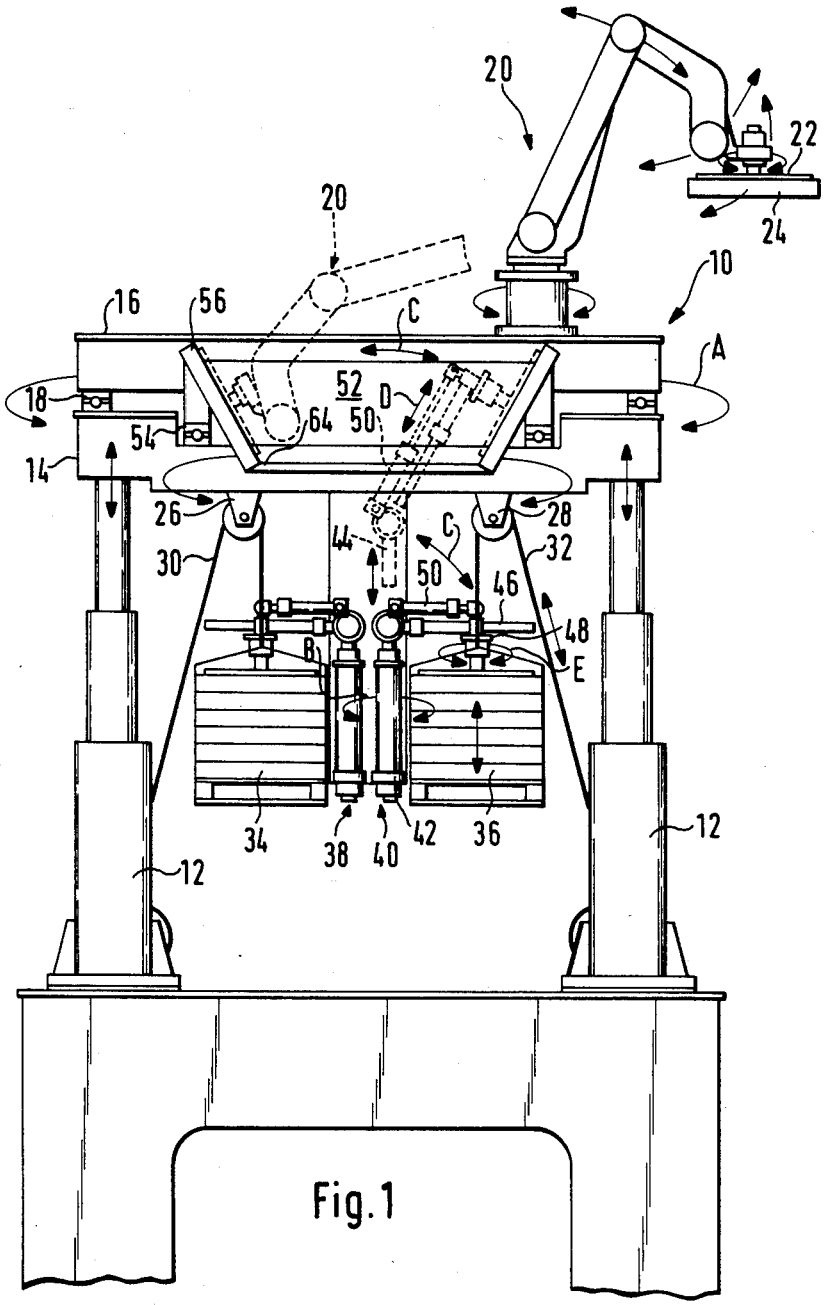
FIG. 1 is a front elevation view of a first embodiment of an apparatus in accordance with the present invention.

The apparatus of the present invention shown in FIG. 1 comprises an operating station 10 carried by several (for example three) telescopic masts 12 by means of which operating station 10 is movable vertically inside a vessel (for example a metallurgical converter which is not shown) the refractory lining of which is to be replaced.

Operating station 10 comprises a supporting stage 14 carried directly by masts 12 and supporting a work platform 16 by means of bearing 18. Platform 16 can thus rotate about the vertical axis of the vessel independently of stage 14, this rotation being symbolized by the arrow A. The rotation of platform 16 allows robot 20 which is mounted on platform 16 to reach the entire circumference of the vessel. The rotation of platform 16 is effected in a way well known to those skilled in the art by an electrical stepping motor (not shown) which can be fastened to stage 14; and the control of which is subject to the work program of robot 20.

Robot 20 can be a conventional robot having several arms articulated on one another and provided with a certain number of degrees of freedom of rotation and pivoting symbolized by the arrows in FIG. 1. The free end of robot 20 is equipped with device 22 for gripping bricks. Gripping device 22 can consist of a suction cup or tongs, the tongs having the advantage of being capable of grasping two superimposed bricks at the same time.

A pair of cables 30, 32 wound respectively about two pulleys 26, 28 fastened underneath stage 14 by means of side plates make it possible to raise and lower brick pallets 34 and 36. As shown in FIG. 1, in the depalletizing position, pallets 34 and 36 remain attached to cables 30 and 32. However, to ensure greater stability of pallets 34 and 36 during depalletization, it is possible to provide, in the depalletization region, two stationary cages which are connected to stage 14 which the pallets enter when they reach the depalletizing position.

Depalletization is carried out by means of two automatic depalletizing mechanisms 38 and 40 fixed to the base of stage 14. Since these automatic mechanisms are identical to one another, the description given below with reference to the automatic mechanism 40 will apply equally to automatic mechanism 38. Automatic depalletizing mechanism 40 is mounted on jack 42 which is capable of rotation about a vertical axis (shown by arrow B) and piston rod 44 which is represented by unbroken lines in the retracted position and by broken lines in the extended position. Mounted on the end of rod 44 is arm 46 pivotable about a horizontal axis relative to rod 44, as illustrated by arrow C. This pivoting can be generated, for example, by an electric motor. A gripping device 48 is slideably mounted on arm 46 and can be moved along the latter in the direction of arrow D by means of a jack 50 which is also fastened to the end of piston rod 44. Gripping device 48 can comprise a suction cup or tongs for taking hold of the bricks on pallet 36; the tongs or suction cup moreover being designed so as to be rotatable about a vertical axis, as represented by the arrow E. The various degrees of freedom of automatic depalletizing mechanism 40, which are represented by the arrows B to E in FIG. 1, allow the automatic mechanism to grasp each of the brick of one layer on pallet 36. After one layer has been exhausted, to gain access to the lower layer on the pallet 36 it is sufficient, by means of cable 32, to raise pallet 36 to a height corresponding to one layer of bricks, or of two bricks if gripping device 48 is equipped with tongs capable of grasping two superimposed bricks at the same time.

Figure 3:
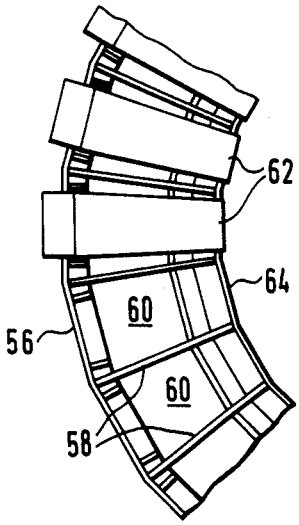
FIG. 3 is a plan view of the turret with reserve bricks in accordance with the present invention.

In accordance with one particularly important feature of the apparatus of the present invention, the bricks depalletized by automatic mechanisms 38 and 40 are deposited in a storage unit which, in the illustrated example, consists of a rotary turret which can rotate about the vertical axis of the present invention and which, for this purpose, is mounted on stage 14 by means of a bearing 54. The rotation of turret 52 is preferably effected by means of an electric stepping motor which is subject to the operating program of robot 20 and those of the automatic mechanisms 38 and 40. In the illustrated embodiment, turret 52 comprises an annular ramp 56 outwardly inclined so as to have substantially the form of a frustoconical surface; the virtual tip of which is at the bottom. Ramp 56 of turret 52, the details of which emerge more clearly from the partial view of FIG. 3, has a lower rim 64 for retaining the bricks and transverse partitions 58 which between them define compartments 60, each capable of receiving one brick 62. The central region of ramp 56 and of each of the compartments 60 is preferably open, thus causing broken bricks to automatically fall out of turret 50 thereby making it unnecessary to carry out an inspection for identification of the broken bricks.

Figure 2:
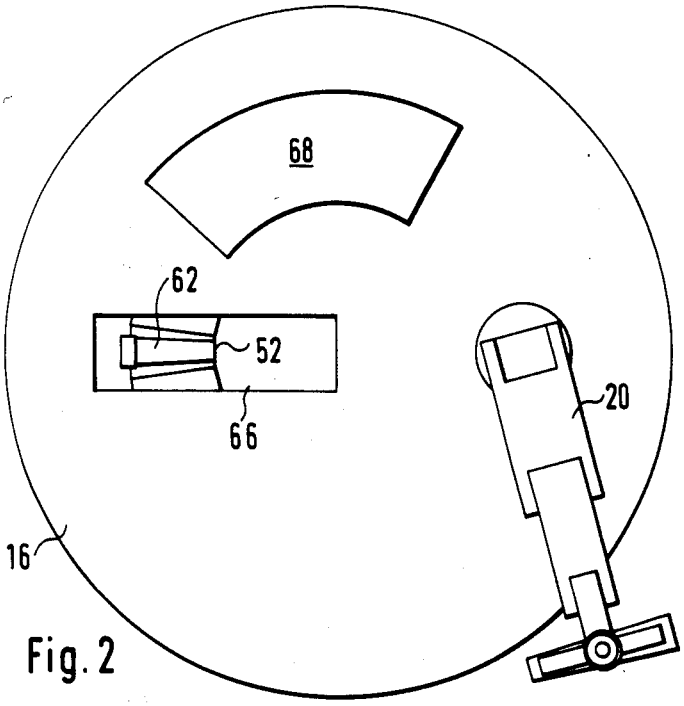
FIG. 2 is a plan view of the work platform of FIG. 1.

As shown in FIG. 2, turret 52 is accessible to the robot 20 via a substantially rectangular radial aperture 66 provided with a work platform 16. During its rotation, turret 52 presents its various compartments 60, together with the bricks 62, to the robot 20 individually underneath the aperture 66. The rotation of turret 52 is subject to the work program of the robot 20, so that it is stopped when a full compartment is underneath aperture 66 and when it is the compartment containing the type of bricks 62 which the robot 20 requires. The reference numeral 68 symbolizes diagrammatically a monitoring booth installed on platform 16. It will be appreciated that, with the exception of booth 68 and robot 20, the surface of work platform 16 is completely free of other obstructions, thus allowing robot 20 to execute its movements freely, without being impeded by cables, pallets or depalletizing devices, as in the apparatuses of the prior art. Because the surface of platform 16 is free, this also makes the job of supervision and monitoring easier and contributes to the safety of the workers. In this respect, a trapdoor may be provided next to aperture 66, in order to close the latter during maintenance and inspection work.

Figure 4:
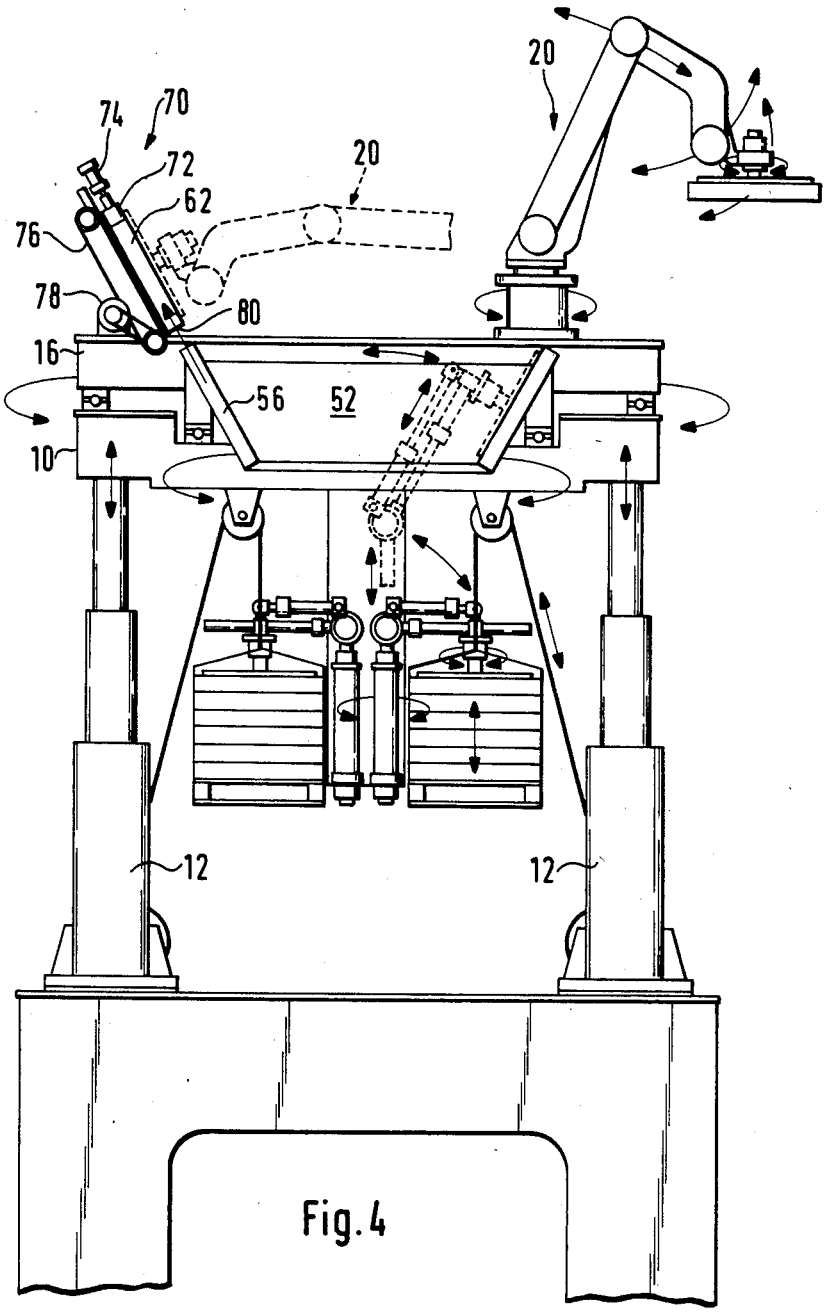
FIG. 4 is a front elevation view of a second embodiment of an apparatus in accordance with the present invention.
Figure 5:
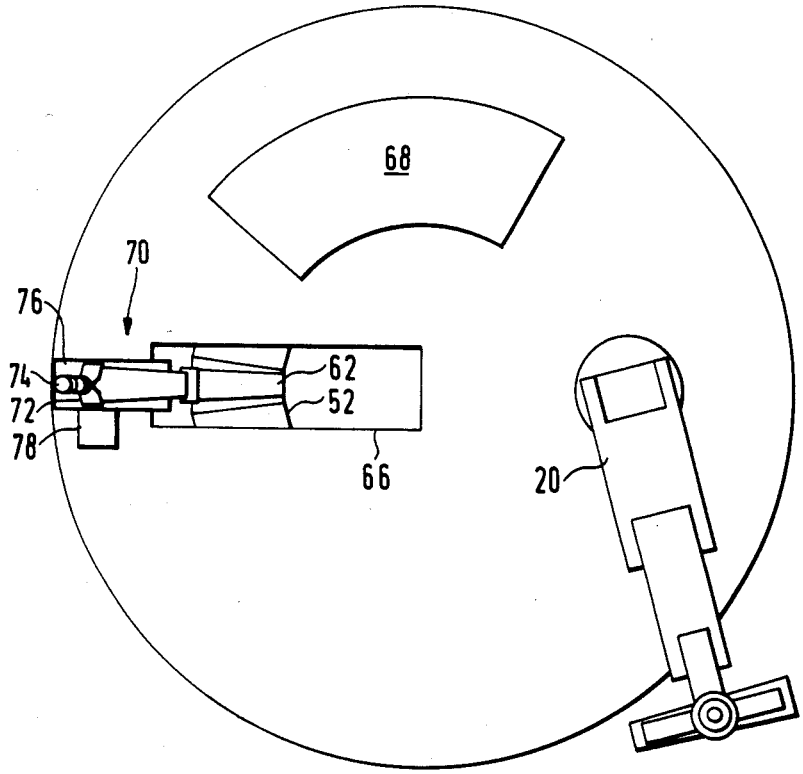
FIG. 5 is a plan view of the work platform of FIG. 4.

While in the embodiment illustrated in FIGS. 1 and 2, robot 20 is served directly from turret 52, in the embodiment shown in FIGS. 4 and 5, robot 20 includes a device 70 for extracting bricks from turret 52. Extraction device 70, which is mounted on platform 16 next to aperture 66, comprises tongs 72 mounted on the rod of a jack 74 with jack 74 being mounted so as to be capable of executing a to-and-fro movement in the extension of slopping ramp 56. In the illustrated embodiment, jack 74 is fastened to an endless belt 76 actuated by means of an electric motor 78. Belt 76 also has a hook 80 for retaining the bricks 62 lifted off from turret 52, after they have been released from tongs 72 and before they are picked up by robot 20. The apparatus of FIG. 4 otherwise corresponds to that of FIG. 1 and functions in the same way.

During the lining of the inner wall of a vessel with bricks, the operating station 10 is mounted at the working height of robot 20 as a result of the extension of telescopic masts 12. Pallets 34 and 36 are replaced by full pallets, as they become empty, by means of cables 30 and 32 and winches (not shown). It will be appreciated that it is still necessary to provide two pallets containing different types of bricks, that is, bricks differing from one another in their conicity, so that it is possible to follow the curve of the vessel and lay brickwork of different radii. For this purpose, the two automatic depalletizing mechanisms 38 and 40 are controlled as a function of the reserve of bricks of each of the types in the turret 52, so that there is a reserve of bricks of each type in turret 52 to allow robot 20 to continue its work during the replacement of a pallet.

It should be noted that automatic mechanisms 38 and 40 illustrated in FIGS. 1 and 4 are only one exemplary embodiment, and that other known devices can be provided for transferring the bricks from each of the pallets 34 and 36 into turret 52.

Ramp 56 of turret 52 may also be inclined inwardly, instead of being inclined outwardly, as in FIGS. 1 and 4. In that case, the bricks would be deposited on the outer conical or frustoconical surface of the ramp of the turret. The two automatic depalletizing mechanisms would then be arranged not between the two pallets, but on either side of these, while the cables for raising and lowering the pallets would pass through the central region between them.

Turret 52, instead of consisting of an inclined annular ramp, may also consist of an annular disc with compartments, in which the bricks are arranged in flat configurations. However, such a turret would be more bulky in the horizontal direction, but would take up less room in the vertical direction.

Instead of providing a single turret, as in FIGS. 1 and 4, it is also possible to provide two independent turrets with an inclined annular ramp, one in the extension of the other and each receiving a particular type of brick. In another alternative embodiment of the present invention, ramp 56 of turret 52 is sufficiently high to define two annular rows of compartments which can each receive a specific type of brick. Of course, all these alternatives increase the capacity of turret 52 and substantially reduce or eliminate the idle times necessary for changing the pallets.

Instead of providing a single aperture 66 in platform 16 for extracting the bricks from the turret 52, it is possible to provide two apertures, that is, each of these apertures would be reserved for the extraction of a specific type of brick. In particular, the two apertures would be useful in the above-described alternative embodiment employing a double turret.

Finally, it must be stressed that the two embodiments described above with reference to FIGS. 1 and 4 are suitable for repairing vessels or converters with an open bottom or with a removable bottom. However, without departing from the scope of the invention, it is possible to adapt these embodiments so that they are capable of working in vessels with a closed bottom, that is, to design the apparatus in such a way that the operating station is suspended in the vessel. For this purpose, it is sufficient to arrange the rotary platform underneath the supporting stage at some distance therefrom. Depalletization would then be carried out on the stage which would then be supported by cables as a substitute for the telescopic masts of the embodiments described above. The robot would still be located on the rotary platform, whereas the turret, which has the reserve of bricks and from which the robot is served, would be mounted on the inner surface of the stage by means of a bearing. The turret may similarly consist of an annular ramp preferably inclined inwardly and carrying the reserve bricks in compartments on the outer conical surface thereof.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Apparatus for lining the inner wall of a vessel with bricks including an operating station capable of being moved vertically along an axis of the vessel, the operating station comprising:
   - rotary work platform means;
   - non-rotary supporting stage means supporting said work platform means by first bearing means;
   - robot means on said work platform means for laying bricks;
   - means for raising and lowering brick pallets;
   - at least one automatic brick-depalletizing means for transferring the bricks from the pallets towards stand-by station means and wherein said stand-by station means comprises;
   - turret means for holding a reserve of bricks, said turret means being supported by said stage means by second bearing means wherein said turret means is rotatable independently of said stage means and said work platform means about a vertical axis of the vessel.

2. Apparatus according to claim 1 wherein:
   - said turret means is mounted between said stage means and said work platform means, said turret means having a surface which includes at least one aperture allowing the passage of at least one brick therethrough.

3. Apparatus according to claim 2, wherein said turret means comprises:
   - an inclined annular ramp divided into individual compartments, each of said compartments containing at least one brick which is deposited therein by said automatic brick depalletizing means.

4. Apparatus according to claim 3 wherein:
   - each of said compartments of said turret means is accessible to said robot means via said aperture in said work platform means as a result of the rotation of said turret means.

5. Apparatus according to claim 2 including:
   - means for extracting bricks from said turret means via said aperture in said work platform.

6. Apparatus according to claim 5 wherein:
said extraction means is arranged on said work platform adjacent said aperture and accessible to said robot means.

7. Apparatus according to claim 1 wherein said automatic brick depalletizing station means is located underneath said stage means and comprises:
at least two automatic brick depalletizing devices fixed to said stage means.

8. Apparatus according to claim 7 wherein each of said automatic depalletizing devices comprises:
a jack capable of rotating about its vertical axis;
a pivoting arm articulated on the end of a rod of said jack; and
brick gripping means slideably mounted on said pivoting arm and rotatable about its vertical axis.

9. Apparatus according to claim 2 wherein:
said surface of said turret is closed except for said at least one aperture.

10. Apparatus according to claim 2 wherein:
said at least one aperture is a radial aperture.

11. Apparatus according to claim 1 including:
monitoring booth means on said work platform means.

12. Apparatus according to claim 1 wherein:
said turret means holds a reserve of bricks of different types.

* * * * *